US006697028B1

(12) United States Patent
Gothard et al.

(10) Patent No.: US 6,697,028 B1
(45) Date of Patent: Feb. 24, 2004

(54) MULTI-BAND RING FOCUS DUAL REFLECTOR ANTENNA SYSTEM

(75) Inventors: Griffin K. Gothard, Satellite Beach, FL (US); Timothy E. Durham, Palm Bay, FL (US); Jay A. Kralovec, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/231,933

(22) Filed: Aug. 29, 2002

(51) Int. Cl.[7] ..... H01Q 19/19

(52) U.S. Cl. ..... 343/781 CA; 343/837; 343/781 P

(58) Field of Search ..... 343/781 P, 781 CA, 343/837, 840

(56) References Cited

U.S. PATENT DOCUMENTS 6,211,834 B1 4/2001 Durham et al. ..... 343/781 P 6,522,305 B2 * 2/2003 Sharman ..... 343/781 CA

* cited by examiner

*Primary Examiner*—Michael C. Wimer
(74) *Attorney, Agent, or Firm*—Sacco & Assoc., P.A.

(57) ABSTRACT

A ring focus antenna and method of using same. The ring focus antenna can have a main reflector of revolution shaped as a non-regular paraboloid about a boresight axis of the antenna. A sub-reflector/feed pair is provided comprising a sub-reflector of revolution shaped as a non-regular ellipsoid having a ring-shaped focal point about the boresight axis. A feed element is installed at a feed element location separated spaced from a vertex of the sub-reflector on the boresight axis of the antenna. The main reflector is adapted for operation with multiple sub-reflector/feed pairs having a coupled configuration, and multiple sub-reflector/feed pairs having a decoupled configuration (i.e. classical optical dual reflector system). The main reflector is operable at a plurality of spectrally offset frequency bands. For example, the antenna can be designed for operation over C-band, X-band, Ku-band, and Ka-band.

19 Claims, 1 Drawing Sheet

MULTI-BAND RING FOCUS DUAL REFLECTOR ANTENNA SYSTEM

BACKGROUND OF THE INVENTION

1. Statement of the Technical Field

The invention concerns antenna systems, and more particularly pseudo-parabolic ring focus antennas configured for multi-band operation.

2. Description of the Related Art

It is desirable for microwave satellite communication antennas to have the ability to operate on multiple frequency bands. However, where space limitations constrain the size of the reflector dish, special techniques must be used to maintain antenna efficiency. One such technique is described in U.S. Pat. No. 6,211,834 B1 to Durham et al. (hereinafter Durham et al.), which concerns a multi-band shaped ring focus antenna.

In Durham et al., a pair of interchangeable, diversely shaped close proximity-coupled sub-reflector-feed pairs are used for operation at respectively different spectral frequency bands. Swapping out the subreflector/feed pairs changes the operational band of the antenna. Advantage is gained by placement of the shaped sub-reflector in close proximity to the feed horn. This reduces the necessary diameter of the main shaped reflector relative to a conventional dual reflector antenna of the conventional Cassegrain or Gregorian variety. The foregoing arrangement of the feed horn in close proximity to the sub-reflector is referred to as a coupled configuration.

The coupled configuration described in Durham et al. generally involves sub-reflector to feed horn spacing on the order of 2 wavelengths or less. This is in marked contrast to the more conventional sub-reflector to feed horn spacing used in a decoupled configuration that is typically on the order of several to tens of wavelengths. Notably, use of a coupled configuration also obviates the problem of phase center migration with frequency as may occur with conventional sub-reflector designs that utilize a decoupled configuration.

One problem with systems that utilize such ring focus reflector geometries is that there is a fundamental limit on the electrical size of the sub-reflector for each feed/subreflector configuration. In the coupled configuration described in Durham et al., the electrical size of the sub-reflector cannot be too large or the feed system for the sub-reflector will fail. In fact, the failure of the feed system resulting from an excessively electrically large sub-reflector is generally the limiting factor in determining the highest operating frequency of an antenna system as described in Durham et al. By comparison, in conventional dual reflector Cassegrain and Gregorian type reflector systems using feed horns and sub-reflectors arranged in accordance with a decoupled configuration, the electrical size of the sub-reflector cannot be too small or the system optics will fail. However, the conventional Cassegrain and Gregorian type reflector systems will not operate with a sub-reflector/feed arranged in a coupled configuration.

From the foregoing it may be appreciated that limitations on sub-reflector size in the various types of antennas and other factors relating to performance have generally created a practical limit to the range of frequencies over which a particular antenna system will operate effectively. Accordingly, new techniques are needed to expand the useful operating range of frequencies to permit dual reflector microwave antenna systems to operate effectively given size and performance constraints on four or more spectrally offset frequency bands.

SUMMARY OF THE INVENTION

The invention concerns a ring focus antenna and method of using same. The ring focus antenna can have a main reflector of revolution shaped as a non-regular paraboloid about a boresight axis of the antenna. A sub-reflector/feed pair is provided comprising a sub-reflector of revolution shaped as a non-regular ellipsoid having a ring-shaped focal point about the boresight axis. A feed element is installed at a feed element location separated spaced from a vertex of the sub-reflector on the boresight axis of the antenna. The main reflector is adapted for operation with a sub-reflector/feed pair having a coupled configuration and a sub-reflector/feed pair having a decoupled configuration. The main reflector is operable at a plurality of spectrally offset frequency bands. For example, the antenna can be designed for operation over C-band, X-band, Ku-band, and Ka-band.

A coupled configuration one of the sub-reflector/feed pairs is advantageously installed on the main reflector for operation of the antenna at a lowest one of the frequency bands. The feed element can further include a feed aperture that is spaced from the vertex of the sub-reflector. The spacing is generally less than about 2 wavelengths for the coupled configuration. A feed aperture can be spaced from the vertex by more than about 5 wavelengths for the decoupled configuration.

DETAILED DESCRIPTION OF THE INVENTION

Shaped ring focus antenna architectures are known in the art. For example, a multi-band ring focus antenna employing shaped-geometry main reflector and diverse-geometry shaped sub-reflector feeds is described in U.S. Pat. No. 6,211,834 B1 to Durham et al., the disclosure of which is hereby incorporated herein by reference. In Durham et al., interchangeable, diversely shaped close proximity-coupled sub-reflector/feed pairs are used with a single multi-band main reflector for operation at respectively different spectral frequency bands. The arrangement of the feed horn in close proximity to the sub-reflector is referred to as a coupled configuration. Swapping out the sub-reflector/feed pairs changes the operational band of the antenna.

The main reflector and the sub-reflector in system described in Durham et al. are respectively shaped as a distorted or non-regular paraboloid and a distorted or non-regular ellipsoid. In general, the shape of the main reflector and the sub-reflector are not definable by an equation as would normally be possible in the case of a regular conic, such as a parabola or an ellipse. Instead, the shapes are generated by executing a computer program that solves a prescribed set of equations for certain pre-defined constraints.

According to a preferred embodiment, an antenna system having broader overall bandwidth can be achieved by using the techniques disclosed in Durham et al. with a combination of sub-reflector/feed pairs that are arranged in a coupled configuration for low frequency operation, and other sub-reflector/feed pairs arranged in a decoupled configuration for higher frequency operation. The main reflector and the sub-reflector can be advantageously shaped using computer modeling and a set of predefined constraints to allow both types of sub-reflector/feed pairs to function with a single multi-band main reflector. Conventional dual reflector systems of the Cassegrain or Gregorian type cannot take advantage of this alternate feed combination because these systems will not operate in a coupled configuration.

Figure 1:
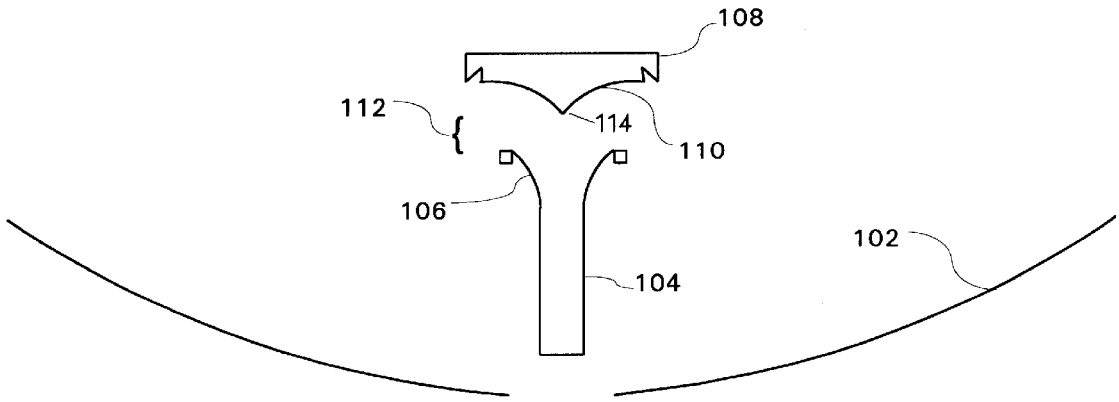
FIG. 1 is a simplified antenna diagram of a multi-band shaped antenna with a sub-reflector/feed pair in a coupled configuration.

FIG. 1 is a simplified drawing of a ring focus antenna that is useful for understanding the present invention. In FIG. 1, a multi-band shaped main reflector 102 is shown together with a sub-reflector/feed element pair comprising a feed element 104 and a sub-reflector 108. The antenna utilizes sub-reflector 108 that has a shaped surface 110 to intercept reflected waves from the main reflector 102, before their normal focal point, and re-reflect them back to the feed element 104. Feed element 104 preferably includes a feed horn 106 for proper matching of the feed element to free space. As shown in FIG. 1, the feed horn 106 is located spaced from a vertex 114 of the sub-reflector 108 and separated by a gap or space 112 that is within two, and preferably less than about 2, wavelengths at the operating frequency of the sub-reflector/feed element pair 104, 108. Consequently, the arrangement of the sub-reflector/feed element pair 104, 108 is referred to as a coupled configuration.

Figure 2:
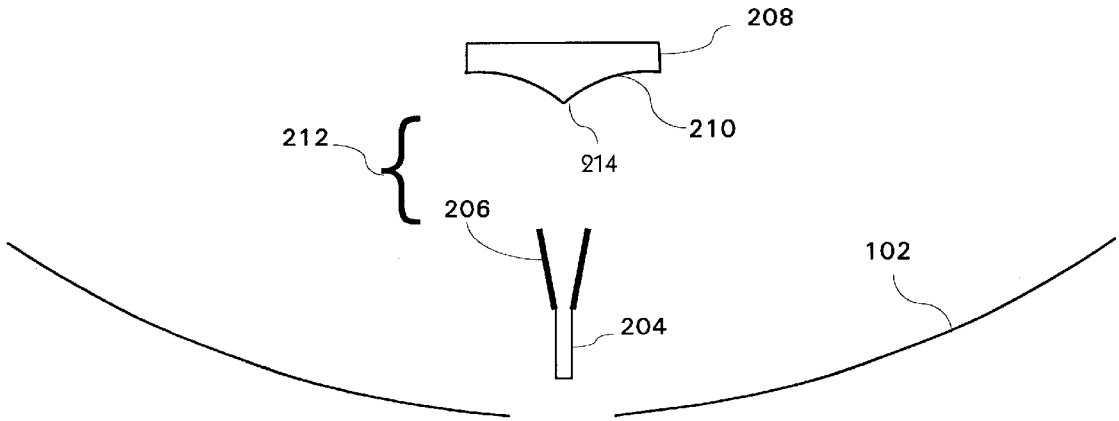
FIG. 2 is a simplified antenna diagram of the multi-band shaped antenna of FIG. 1 with an alternative sub-reflector/feed pair in a decoupled configuration.

Advantageously, it has been found that the main reflector 102 can be configured so that its use is not limited to a coupled configuration as shown in FIG. 1. Instead, the shape of the main reflector 102 can be configured such that the main reflector 102 will also function with a decoupled sub-reflector/feed element pair. FIG. 2 shows the main reflector 102 of FIG. 1 in use with a second sub-reflector/feed element pair comprising feed element 204 and sub-reflector 208. The feed element 204 includes a feed horn 206 spaced apart from a vertex 214 defined in the surface 210 of the subreflector 208 as shown. The feed element 204 and sub-reflector 208 are configured for operation at a higher frequency band as compared to the sub-reflector/feed element pair 104, 108 in FIG. 1.

The antenna arrangement in FIG. 2 operates generally in the same manner as described above relative to FIG. 1 except that the gap or space 212 between the vertex 214 of the sub-reflector 208 and the feed horn 204 is considerably larger as compared to gap 112, at least in terms of relative number of wavelengths at the operating frequency. For example the space 212 can be more than 5 and is preferably more than eight wavelengths at the operating frequency of the sub-reflector/feed element pair 204, 208. Consequently the arrangement of the sub-reflector/feed element pair 204, 208 is referred to as a decoupled configuration. Thus, the main reflector 102 advantageously can be shaped to operate with a sub-reflector/feed element pair of both a coupled configuration and a decoupled configuration.

A significant advantage of configuring main reflector 102 so that its shape will accommodate coupled and decoupled sub-reflector/feed element pairs is that the operating bandwidth of the main reflector 102 can be increased beyond that which would be possible using only a coupled or decoupled sub-reflector/feed combination. More particularly, for conventional systems such as Cassegrain or Gregorian type arrangements using decoupled sub-reflector/feed element pair configurations, the electrical size of the sub-reflector cannot be too small or the system optics will fail. This will limit the lower frequency limits of operation for such an antenna given a main reflector of a particular diameter. Conversely, for the coupled configuration, the electrical size of the sub-reflector 108 cannot be made too large or the feed system will fail. Consequently, for a given dish size (usually specified), a decoupled design will not be able to meet certain required specifications to the lowest desired frequency of operation, whereas a coupled configuration will. The physical range of operation of the coupled design is 1 to 15 wavelengths for the sub/splash plate diameter. By creating a multi-band main reflector that can benefit from the advantages of both coupled and decoupled feed configurations, the overall range of frequencies over which the main reflector 102 can be used with multiple sub-reflector/feed element combinations is significantly increased as compared to the prior art. In fact, a combined system that uses coupled and decoupled types of sub-reflector/feed pairs can achieve an operational bandwidth for a single main reflector that is improved by about an order of magnitude as compared to designs using exclusively coupled or exclusively decoupled configurations.

According to a preferred embodiment, the precise shape of the main reflector 102 can be determined based upon computer analysis. The main reflector geometry is advantageously configured for use interchangeably with each of respectively differently configured sub-reflectors and associated feeds for different frequency bands, having both coupled and decoupled configurations. The reflector geometry also is configured to realize a composite optical geometry characteristic that satisfies the set of performance criteria (e.g. directivity pattern having a reduced or substantially suppressed sidelobe envelope) at the respective different operational frequency bands. The resulting shape of the main reflector is a conical surface of revolution that is generally, but not necessarily precisely, parabolic. The resulting shape of the sub-reflector is likewise a conical surface of revolution that is generally, but not necessarily precisely, elliptical.

Given prescribed feed inputs and boundary conditions for the antenna, the shape of each of a sub-reflector and a main reflector are generated by executing a computer program that solves a prescribed set of equations for the predefined constraints. In accordance with a preferred embodiment of the invention, the equations employed are those which: 1—achieve conservation of energy across the antenna aperture, 2—provide equal phase across the antenna aperture, and 3—obey Snell's law. Details regarding this process are disclosed in U.S. Pat. No. 6,211,834 to Durham et al.

For a given set of generated sub-reflector/feed element configurations and shapes, and main reflector shapes, the performance of the antenna is then analyzed by way of computer simulation, to determine whether the generated antenna shapes will produce a desired directivity characteristic. The lower frequency bands of operation are presumed to make use of one or more coupled configuration sub-reflector/feed element pairs.

An example of a low band system specification would be one that is compliant with Intelsat sidelobe envelope requirements at a prescribed operational band (e.g., C-band having a receive bandwidth of 3.7–4.2 GHz and a transmit bandwidth of 5.9–6.4 GHz). If the design performance criteria are not initially satisfied, one or more of the equations' parameter constraints are iteratively adjusted, and the performance of the antenna is analyzed for the new set of shapes. This process is iteratively repeated, as necessary until the shaped antenna sub-reflector shape and coupling configuration, and main reflector shape, meets the antenna's intended operational performance specification.

This iterative shaping and performance analysis sequence is also conducted for another (spectrally separate) band, such as X-band having a receive bandwidth of 7.25–7.75 and a transmit bandwidth of 7.9–8.4 GHz, to realize a set of sub-reflector and main reflector shapes at the second operational band. The higher bands of operation are advantageously configured with a sub-reflector/feed element configuration that is decoupled. However, the invention is not so limited. It has been determined that the shape of the main reflector 102 can be the substantially the same for a plurality of spectrally offset frequency bands, although differently configured subreflectors with different coupling arrangements can be used for each band. Although each set of subreflector and main reflector shapes may be derived separately, as described above, it is also possible to derive a first set of shapes for a first band, and then use the parameters for the (first band) shaped main reflector (which is also to be used for the second band) to derive the shape of the subreflector for the second band.

We claim:

1. An antenna comprising:

a plurality of sub-reflector/feed pairs respectively configured for operation at different ones of a plurality of spectrally offset frequency bands of operation of said antenna, each said sub-reflector/feed pair comprising a sub-reflector having a shaped non-linear surface of revolution about a boresight axis of said antenna for forming a ring-shaped focal point about said boresight axis, and a feed element installed at a feed element location separated by a gap from a vertex of said sub-reflector on said boresight axis of said antenna;

a main reflector having a shaped surface of revolution about said boresight axis of said antenna and being operable at said plurality of spectrally offset frequency bands, said main reflector adapted to have individually installed thereon each said sub-reflector/feed pair; and wherein at least one of said sub-reflector feed pairs is of a coupled configuration and at least a second one of said sub-reflector feed pairs is of a decoupled configuration.

2. The antenna according to claim 1 wherein a coupled configuration one of said sub-reflector/feed pairs is installed on said main reflector for operation of said antenna at a lowest one of said plurality of spectrally offset frequency bands.

3. The antenna according to claim 1 wherein said feed element is further comprised of a feed aperture and said gap is less than about 2 wavelengths of the frequency of operation of said antenna from said vertex of said sub-reflector to said feed aperture for said coupled configuration.

4. The antenna according to claim 1 wherein said feed element is further comprised of a feed aperture and said gap is more than about 5 wavelengths of the frequency of operation of said antenna from said vertex of said sub-reflector to said feed aperture for said decoupled configuration.

5. The antenna according to claim 1, wherein at least one of said shaped main reflector and said shaped sub-reflector has no continuous surface portion thereof shaped as a regular conical surface of revolution.

6. The antenna according to claim 1, wherein said spectrally different frequency bands are selected from the group consisting of C-band, X-band Ku-band and Ka-band.

7. The antenna according to claim 6, wherein said sub-reflector feed pair for C-band and X-band are of coupled configuration and said sub-reflector feed pair for Ku-band and Ka-band are of decoupled configuration.

8. The antenna according to claim 1, wherein said main reflector and at least one of said sub-reflectors are shaped as respectively different non-regular conical surfaces of revolution.

9. The antenna according to claim 8, wherein at least one of said sub-reflectors is shaped as a distorted ellipsoid and said main reflector is shaped as a distorted paraboloid.

10. The antenna according to claim 1, wherein said sub-reflector comprises a selected one of a plurality of different sub-reflectors respectively configured for operation at different frequency bands, and wherein said feed element comprises a selected one of a plurality of different feed elements respectively configured for operation at said different frequency bands, whereby the band of operation of said antenna is that of said selected sub-reflector and said selected feed element.

11. An antenna for operation over a plurality of spectrally offset frequency bands comprising:

a ring focus antenna having a main reflector of revolution shaped as a non-regular paraboloid about a boresight axis of said antenna, and a sub-reflector/feed pair comprising a sub-reflector of revolution shaped as a non-regular ellipsoid having a ring-shaped focal point about said boresight axis, and a feed element installed at a feed element location separated spaced from a vertex of said sub-reflector on said boresight axis of said antenna; and wherein said main reflector is adapted for operation with at least one said sub-reflector/feed pair having a coupled configuration and at least one sub-reflector/feed pair having a decoupled configuration.

12. The antenna according to claim 11 wherein said main reflector is operable at a plurality of spectrally offset frequency bands and a coupled configuration one of said sub-reflector/feed pairs is installed on said main reflector for operation of said antenna at a lowest one of said frequency bands.

13. The antenna according to claim 11 wherein said feed element is further comprised of a feed aperture that is spaced from said vertex by less than about 2 wavelengths for said coupled configuration.

14. The antenna according to claim 11 wherein said feed element is further comprised of a feed aperture that is spaced from said vertex by more than about 5 wavelengths for said decoupled configuration.

15. The antenna according to claim 11, wherein said spectrally offset frequency bands comprise C-band, X-band, Ku-band, and Ka-band.

16. The antenna according to claim 15, wherein said sub-reflector feed pair for C-band and X-band are of coupled configuration and said sub-reflector feed pair for Ku-band and Ka-band are decoupled configuration.

17. A method of configuring an antenna for operation at a selected one of a plurality of different frequency bands, comprising the steps of:

providing a ring focus antenna having a main reflector of revolution shaped as a non-regular paraboloid about a boresight axis of said antenna, and positioning on said boresight axis a sub-reflector/feed pair comprising a sub-reflector of revolution shaped as a non-regular ellipsoid having a ring-shaped focal point about said boresight axis, and a feed element installed at a feed element location separated spaced from a vertex of said sub-reflector on said boresight axis of said antenna, said sub-reflector/feed pair selectively chosen from an interchangeable group consisting of a coupled configuration and a decoupled configuration.

18. The method according to claim 17 further comprising the step of selecting a first sub-reflector/feed pair from said interchangeable group that has a coupled configuration for operation at a first design operating frequency range, and a second sub-reflector/feed pair that has a decoupled configuration for operation at a second design operating frequency range, wherein said first design operating frequency range is lower than said second design operating frequency range.

19. The method according to claim 17 wherein said main reflector is configured for operation at different ones of a plurality of spectrally offset frequency bands and further comprising the step of selecting a sub-reflector/feed pair having a coupled configuration for operation of said antenna at a lowest one of said frequency bands.

* * * * *